United States Patent [19]

Fischer

[11] Patent Number: 4,598,641

[45] Date of Patent: Jul. 8, 1986

[54] PRINTING CYLINDER CONSTRUCTION FOR SHEET-FED OFFSET ROTARY PRINTING MACHINE

[75] Inventor: Hermann Fischer, Augsburg, Fed. Rep. of Germany

[73] Assignee: M.A.N.-ROLAND Druckmaschinen Aktiengesellschaft, Offenbach am Main, Fed. Rep. of Germany

[21] Appl. No.: 697,735

[22] Filed: Feb. 4, 1985

[30] Foreign Application Priority Data

Feb. 4, 1984 [DE] Fed. Rep. of Germany ..... 3403893

[51] Int. Cl.[4] ..... B41F 21/04

[52] U.S. Cl. ..... 101/246; 101/409; 271/82

[58] Field of Search ..... 101/409, 410, 411, 412, 101/246; 271/82, 85, 204, 206, 277

[56] References Cited

U.S. PATENT DOCUMENTS

| | | | |
|---|---|---|---|
| 1,208,731 | 12/1916 | Blaine | 101/412 |
| 1,303,793 | 5/1919 | Henderson et al. | 101/412 |
| 1,916,454 | 7/1933 | Wohlrabe | 101/142 |
| 3,796,154 | 3/1974 | Weisgerber | 101/409 X |
| 4,427,193 | 1/1984 | Kahlert et al. | 271/277 |

FOREIGN PATENT DOCUMENTS

| | | | |
|---|---|---|---|
| 653558 | 12/1962 | Canada | 101/409 |
| 155403 | 10/1903 | Fed. Rep. of Germany . | |
| 611993 | 4/1935 | Fed. Rep. of Germany | 101/409 |
| 72268 | 12/1970 | German Democratic Rep. | 101/409 |
| 143150 | 8/1980 | German Democratic Rep. | 101/409 |

*Primary Examiner*—Charles A. Pearson

*Attorney, Agent, or Firm*—Frishauf, Holtz, Goodman & Woodward

[57] ABSTRACT

To reliably hold a sheet in a rotary sheet-fed offset printing machine, a plurality of pin or needle-like projections (11), preferably held on a holding strip (12), are located transversely just behind or beneath the grippers. The sheet is pressed against the pins by the rubber blanket of the blanket cylinder, to impale the sheet on the pins; or, if the projections are located beneath the grippers, the grippers indirectly apply pressure on the sheet to impale the sheet on the projections. In another embodiment (FIG. 6), a pressure block (13) with a resilient engagement surface (14) presses the grippers on the sheet for also impaling the sheet on the pins or needles. The projections may also be formed as knife edges (FIG. 4). Alternatively, the printing line can be shifted forwardly (FIG. 5), so that the rubber blanket will engage the ends of the grippers.

20 Claims, 8 Drawing Figures

P
1
2
3
4
5
6
7
8
9
10
11
12

PRINTING CYLINDER CONSTRUCTION FOR SHEET-FED OFFSET ROTARY PRINTING MACHINE

The present invention relates to offset rotary printing machines, and more particularly to a printing cylinder, or impression cylinder therefor, in which the printing or impression cylinder may be a separate element cooperating with a rubber blanket cylinder or may, itself, be a rubber blanket cylinder, or a plate cylinder, hereinafter, for short, "printing cylinder"; and especially to such a machine in which the printing cylinder has grippers thereon to grip an edge of the sheet on which printing is to be effected upon passage of the sheet between the printing cylinder and the blanket cylinder at a printing line.

BACKGROUND

It is well known that sheet-fed rotary offset printing machines subject the sheets to substantial tension; this is particularly so in five-cylinder systems, in which two blanket cylinders cooperate with a counter or impression printing cylinder. The tension applied to the sheet occurs during the time when the sheet is carried between the printing cylinder and the rubber blanket cylinders. These tension forces have the tendency to pull the sheet out of the grippers on the printing cylinder in which the sheet is held.

It has been observed that the forces which act on the sheet, and which may cause shifting of the upper leading edge thereon, may result in ghosts, and double-printing on the sheet, particularly along the trailing portion thereof. Even if the gripper closing forces are comparatively high, the grippers and the counter-engagement surface, or both, are roughened or knurled or otherwise made to have a high friction, ghosts on the sheet can still not be avoided at all times, since the sheet still may move or slip between the grippers due to the high tension forces acting on the sheets. The slip of the sheet in the grippers is frequently non-uniform across the width of the machine. Often, the sheet slips in the center region more than at the edges.

It has been proposed—see German Pat. No. 155,403—to apply projecting pins on the grippers which perforate the sheet to be gripped, in order to improve the reliability of holding of the sheet by the grippers. It has been found that such gripper systems in which pins are located on the grippers will improve the gripping effect only at specific points where the pins are located since, because the grippers are spaced from each other, not all of the grippers may close reliably.

THE INVENTION

It is an object to improve the holding of sheets by grippers in printing cylinders, in which the holding force is essentially uniformly distributed over the entire width of the sheet, while improving the operation of the grippers themselves.

Briefly, penetrating projections which extend axially along the printing cylinder, for example in a row, are positioned—with respect to the direction of rotation of the printing cylinder—in a zone extending from close to behind the engagement surface of the grippers to beneath the engagement surface of the grippers. The projections are shaped and located for penetration of the sheet on which printing is to be effected, and held in the grippers, upon application of a force against the sheet pressing the sheet on the projections during rotation of the blanket cylinder and engagement of the sheet by the blanket cylinder.

In accordance with a feature of the invention, the blanket of the blanket cylinder itself presses the sheet down on the projections, or presses on the grippers so that the grippers will press the sheet on the projections; or, in accordance with another feature of the invention, a pressure block is located in the groove region of the blanket cylinder, that is, the region where the rubber blanket of the blanket cylinder is secured to the blanket cylinder, which presses the sheet and/or the grippers on the projections. Preferably, the pressure block includes a foam or resilient or cushioning element, for resilient pressure engagement of the grippers.

DRAWINGS

DETAILED DESCRIPTION

The general structure of a sheet-fed rotary printing machine may be in accordance with any well known design; the present invention is directed specifically to holding of paper sheets 8 in grippers 6 on the printing cylinder of the machine.

Figures 1, 2, 3, 4:
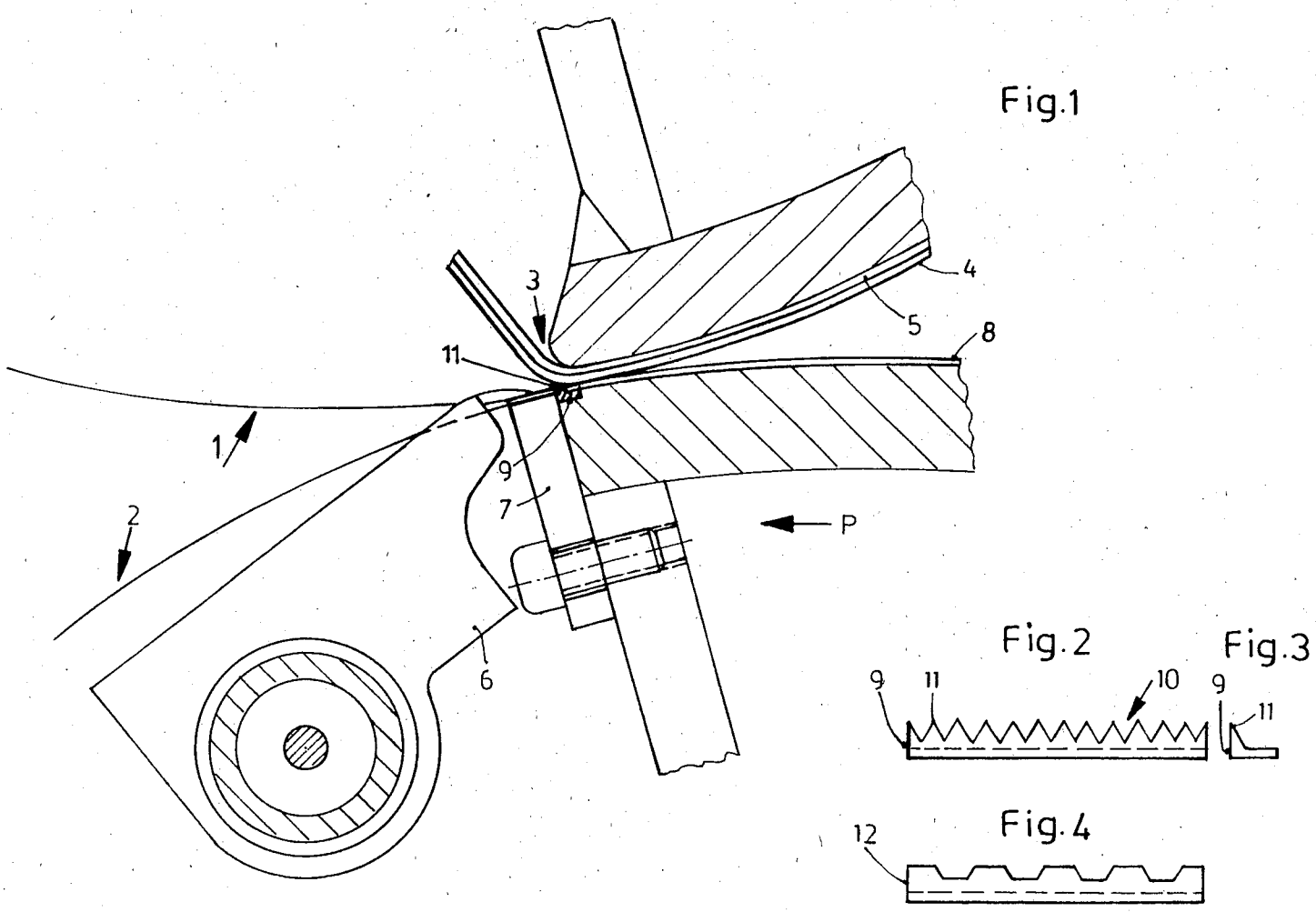
FIG. 1 is a fragmentary schematic side view, partly in section, of a rubber blanket cylinder, a printing cylinder, and the gripper arrangement thereon, and illustrating the holding arrangement in accordance with the present invention.
FIG. 2 is a side view of a holding strip with sawtooth projections.
FIG. 3 is an end view of the strip of FIG. 2.
FIG. 4 is a view similar to FIG. 2, and illustrating a modification.

FIG. 1 illustrates, in fragmentary representation, the region of the clamping grooves of a rubber blanket cylinder 1, and of the printing cylinder 2. The region 3 of the clamping groove is constructed, in customary manner, to provide for attachment of a rubber blanket 4 which is located on a pad or underlay 5. The clamping arrangement itself may be in accordance with any well known structural arrangement.

The groove of the printing cylinder has grippers 6 located therein which cooperate with an engagement surface 7. The grippers are pivotable, to grip a sheet 8 between the end portions of the grippers 6 and the engagement surface 7 when the grippers are pivoted into the position shown in FIG. 1. Upon gripping sheet 8, printing is effected by transferring ink from the rubber blanket 4 on the sheet 8. The direction of rotation of the printing cylinder 2 is indicated by the arrow P.

Upon printing on the sheet 8, substantial tension forces will be applied to the sheet 8 which tend to pull the sheet 8 from between the grippers 6 and the engagement surface 7.

In accordance with the present invention, at least one pin, and preferably a row of pins or projections 10 are provided to hold the sheet 8 in position. In accordance with an embodiment of the invention as shown in FIG. 1, the row 10 of the pins is located on a perforating strip 9. The perforating strip 9, in cross section, is approximately right angle-shaped—see FIG. 3—and the projections are formed as points 11 on the perforating strip 9. The perforating strip 9 is located immediately behind the engagement surface 7.

Placing the perforating strip 9 immediately behind the gripper engagement surface 7 will result in impaling the leading edge of the sheet 8 on the projections 11 of the strip 9 by force applied by the rubber blanket cylinder 1 engaged with the printing cylinder 2 after the grooves have run against each other. Preferably, the blanket cylinder and the printing cylinder are so circumferentially adjusted with respect to each other that the blanket 4 on the blanket cylinder presses the sheet 8 just in advance of the printing line against or on the tips of the pins or projections 11 of the perforating strip 9. Thus, the blanket 4 of the blanket cylinder provides for engagement force for impaling the sheet 8 on the tips or points 11. At the same time, the function of the grippers themselves, and particularly the closing function of the grippers, is substantially improved.

The perforating strip 9 preferably is slightly recessed within the printing cylinder 2—see FIG. 1—so that only the tips or points 11 extend over the outer circumferential surface of the printing cylinder 2. Since the points 11 penetrate into the sheet 8 in advance of the zone of printed material, that is, in a print-free region of the leading edge of the sheet 8, the printed copy itself is not changed or interfered with. As is well known, the leading strip where the sheet is held is usually removed anyway.

The perforating strip 9 shown in FIGS. 2 and 3 may extend over the entire width of the machine, that is, over the entire axial extent of the cylinder 2. It is not necessary that the strip with the tips 11 extend over the entire width. Extending the strip over the entire width of the sheet increases the holding force which can be applied on the sheet 8. Frequently it is sufficient, however, if the strip 9 extends only over a portion of its width, for example between the grippers. The strips 9 can be located in a groove formed immediately adjacent the engagement surface 7, and held in position by an adhesive, by screws, or in any other suitable manner.

Use of the strip with the points 11 has a substantial advantage over grippers on which pins are located. The perforating strips 9 can be placed on the cylinder 2 at any desired and suitable location, independently of the position and operation of the grippers, and as required, to obtain sufficient and uniform additional holding force for transport of the sheets 8.

Various changes may be made; rather than using a perforating strip 9 as shown in FIGS. 2 and 3, other strips, holders for individual pins or needles, or even only individual pins or needles, may be used, set into the printing cylinder 2. One modification is shown in FIG. 4, in which a perforating strip 12 is shown which does not use pointed tips but, rather, knife edges which, generally, are approximately trapezoidally shaped—in side view, as seen in FIG. 4—and which can cut perforating slits into the sheet 8, and hold the sheet 8.

EMBODIMENT OF FIG. 5

Figure 5:
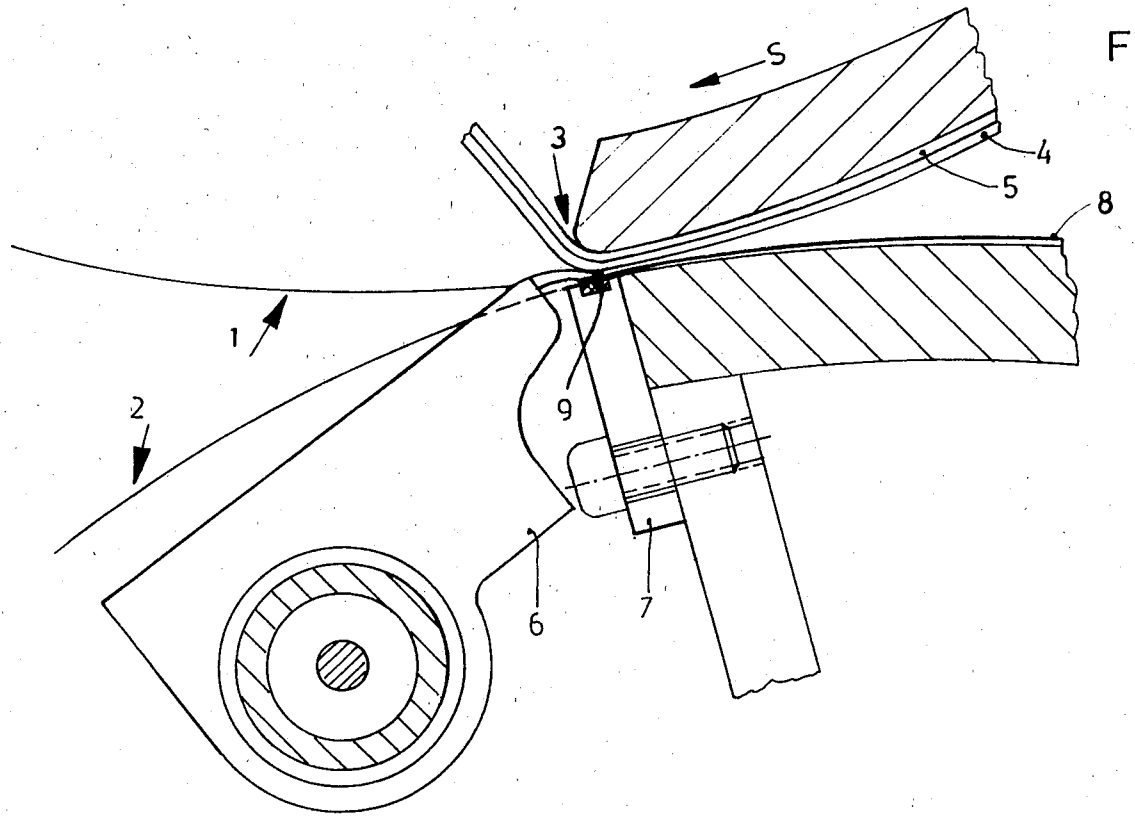
FIG. 5 is a view similar to FIG. 1, and illustrating another embodiment, in which the printing line is shifted forwardly.

The difference between the structures illustrated in FIGS. 1 and 5 is the location of the printing line. The position of the blanket cylinder 1, with respect to the printing cylinder 2, has been shifted, for example by changing the position of the center of the blanket cylinder 1 by means of an eccentric bearing holder, so that the printing line is shifted forwardly in direction of the groove 3. This improves the closing of the grippers 6. The strip holding the perforating points or blades (FIGS. 2, 3) is located in or on the gripper engagement surface 7. The rubber blanket 4 will engage the end portions of the grippers to press the sheet 8 on the holding tips or blades, by pressing the end portions of the gripper against the sheet, thus impaling the sheet on the tips or blades.

Figure 6:
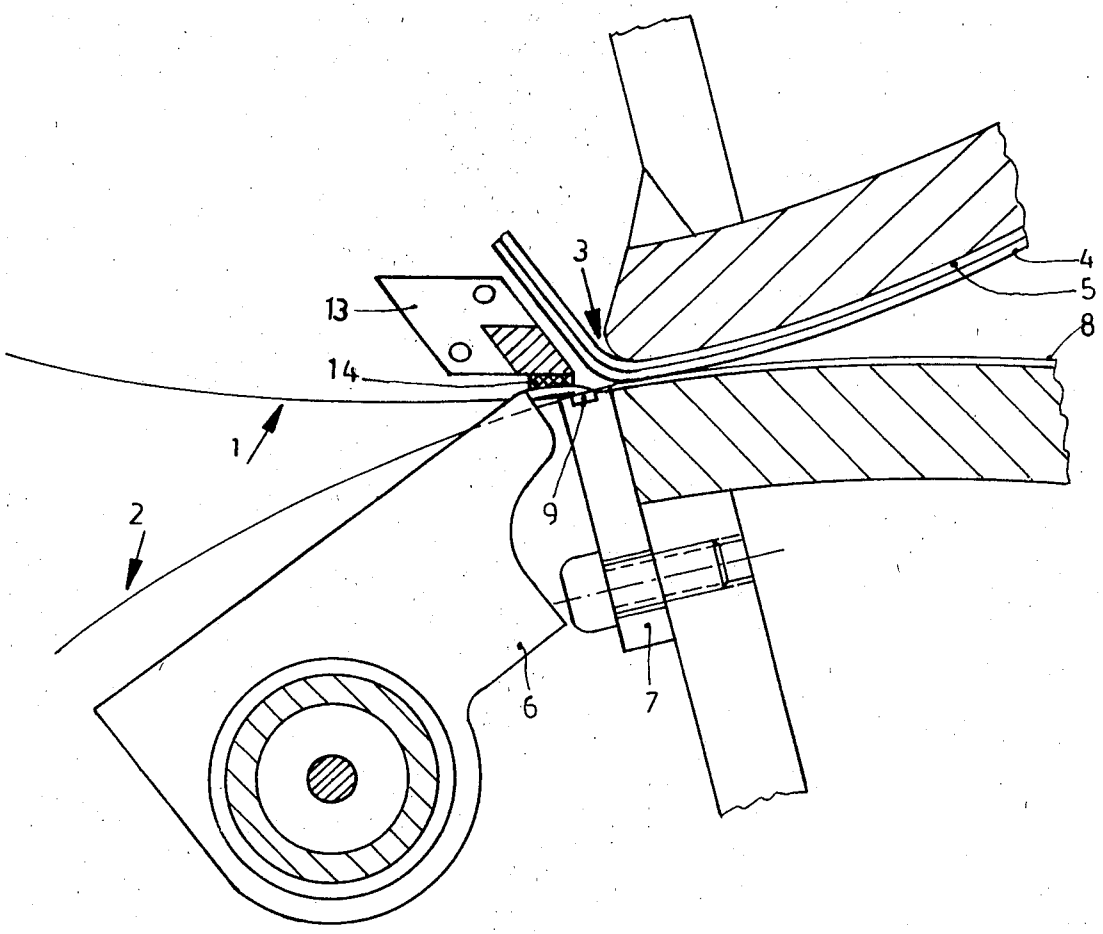
FIG. 6 is a view similar to FIG. 1 including a hold-down block to hold the grippers.

The embodiment of FIG. 6 illustrates a variation in which the position of the blanket cylinder 1 and of the plate cylinder 2 remains as in FIG. 1; a pressure block 14, with a pillow of foam or other resilient material, is secured in a suitable manner, for example by screws, within the groove 3, and positioned to engage the end portions of the grippers to elastically compress the end portions of the grippers against the sheet 8, so that the sheet 8 will be impaled on tips or pins or knife blades located beneath the gripper surface of the end portions of the grippers themselves.

EMBODIMENT OF FIG. 7

Figure 7:
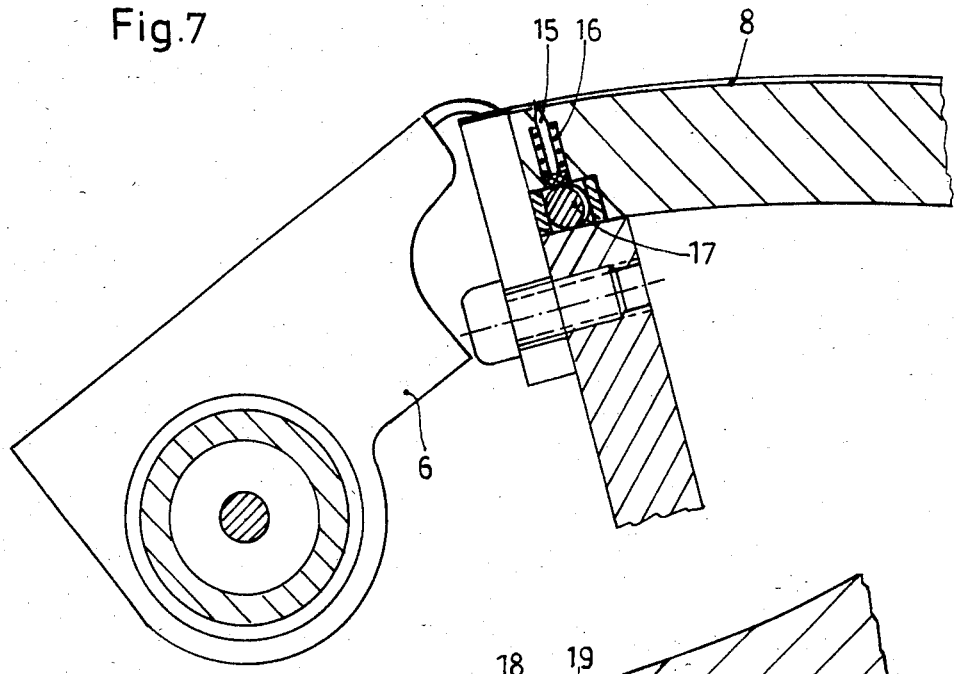
FIG. 7 is a view similar to FIG. 1, and illustrating an arrangement for axial positioning of projections, omitting the blanket cylinder.

Needles 15, located in a row, are positioned by an eccentric element 17, pressing the needles upwardly counter the force of a spring 16. The projection distance of the tips of the needles thus can be adjusted to match the thickness of the sheets 8. The needles 15 are located in a row—only one needle is visible in FIG. 7. The blanket cylinder 1 has been omitted from the showing of FIG. 7, and may be positioned as shown in FIG. 1 or 5, or may be equipped with the pressure block 13, 14 (FIG. 6).

Figure 8:
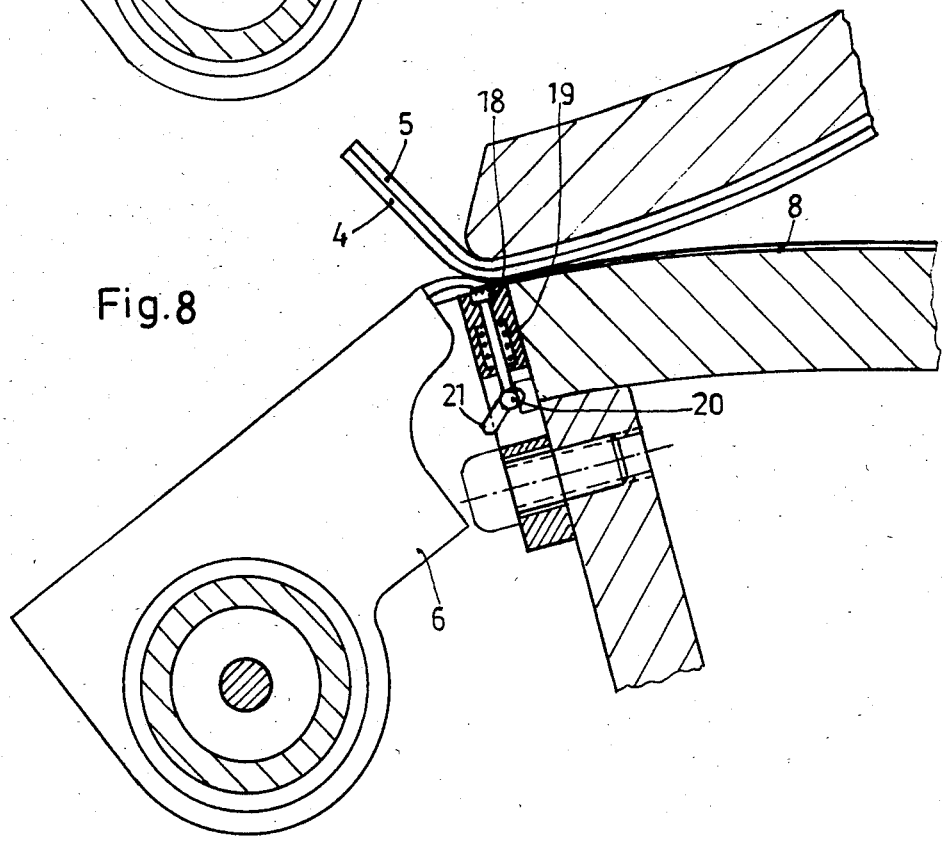
FIG. 8 is a view similar to FIG. 5, illustrating another arrangement for placement of the projections, selectively, to accomodate different thicknesses of sheets.

FIG. 8 shows another modification in which a plurality of tips or knife blades, for example located on strips (FIGS. 2, 4), are positioned by an eccentric element 20, operable by a lever 21. The projection distance of the tips or knife blades on the strip is determined by the position of the strip controlled via a rod 18 engaging the eccentric element 20. A spring 19 normally holds the tips or knife blades in retracted position, for example by engagement against a shoulder or spring washer snapped on the rod 18. The rod 18 can be adjusted counter the force of the spring 19 if it is not desired to mark or impale sheets on the strip at the end of the rod 18.

The term "printing cylinder", as used herein, may be a blanket cylinder or a plate cylinder with grippers, as desired, in accordance with the general design of the machine.

Various changes and modifications may be made, and features described in connection with any one of the embodiments may be used with any of the others, within the scope of the inventive concept.

Preferably, the end portions of the grippers are formed as resilient elements, for example spring blade elements which can deflect under the pressure of the blanket 4 rolling against it; this is particularly desirable for the embodiment shown in FIGS. 5 and 8. In the embodiment of FIG. 6, the resilient compression of the grippers is obtained by the cushion or pillow 14 of foam or other flexible material.

I claim:

1. Sheet-fed rotary offset printing machine having a printing couple including a rubber blanket cylinder structure (1) and a printing cylinder (2); and a gripper structure having movable gripper elements (6) and an engagement surface (7) secured to the printing cylinder, for gripping a sheet (8) between the gripper structure and the engagement surface, and pulling the sheet through a printing line between the rubber blanket cylinder and the printing cylinder, and comprising, in accordance with the invention, means for insuring reliable gripping of the sheet, without slippage, between the gripper structure (6) and the engagement surface (7), including penetrating projection means (11, 12) positioned on the printing cylinder and located—with respect to the direction of rotation (P) of the printing cylinder (2)—in a zone extending from close to and behind the engagement surface to, and including the engagement surface, the penetrating projection means being located for penetration of a sheet (8) by the projection means (11, 12), said blanket cylinder structure serving as a means for applying a force against the sheet to cause said projection means to penetrate said sheet as the sheet is held by the gripper elements and as the blanket cylinder structure rotates, said force acting in a direction which presses the sheet onto said projection means.

2. Machine according to claim 1, wherein the projection means are positioned behind the region of engagement of the gripper structure (6) and said engagement surface (7).

3. Machine according to claim 2, wherein the blanket cylinder structure and the printing cylinder are located with respect to each other to apply said force on the sheet to impale the sheet on said projection means.

4. Machine according to claim 2, wherein the blanket cylinder and the printing cylinder are located with respect to each other for application of said force by the rubber blanket cylinder directly on the sheet to impale the sheet on said projection means.

5. Machine according to claim 1, wherein the gripper elements have gripping end portions;

and said projection means are located under said gripping end portions.

6. Machine according to claim 5, wherein said blanket cylinder structure includes a rubber blanket and wherein the rubber blanket cylinder and the printing cylinder are located with respect to each other to apply said force by the rubber blanket (4) on the rubber blanket cylinder structure (1) against the gripping end portions of the gripper elements (6) for indirectly pressing the sheet against said projection means and for impaling the sheet on said projection means.

7. Machine according to claim 5, wherein the blanket cylinder structure includes a groove portion; and a pressure block (13) is provided, secured in the groove portion of the blanket cylinder structure (1), said pressure block including a resilient engagement surface (14), the resilient engagement surface applying said force against the sheet for impaling the sheet on the projection means.

8. Machine according to claim 1, wherein said projection means are located in an axial row extending at least partially axially across the printing cylinder (2).

9. Machine according to claim 8, wherein the projection means extend over essentially the entire axial length of the printing cylinder (2).

10. Machine according to claim 1, wherein the projection means comprises a holding strip (9, 12) on which a plurality of impaling penetrating projections are located; and said projections extend radially outwardly from the surface of the printing cylinder (2).

11. Machine according to claim 10, wherein the holding strip (9) is radially movably secured in the printing cylinder (2) permitting only the projection means (11) to extend beyond the circumferential surface of the printing cylinder (2).

12. Machine according to claim 11, including height-adjustable means (17, 20, 21) coupled (18) to the projection means for controlling the extent of projection of said projection means beyond the surface of the printing cylinder.

13. Machine according to claim 1, wherein the blanket cylinder structure and the printing cylinder are located with respect to each other to apply said force on the sheet to impale the sheet on said projection means.

14. Machine according to claim 1, wherein the blanket cylinder structure includes a groove portion; and a pressure block (13) is provided, secured in the groove portion of the blanket cylinder structure (1), said pressure block including a resilient engagement surface (14), the resilient engagement surface applying said force against the sheet for impaling the sheet on the projection means.

15. Machine according to claim 14, wherein said pressure block and the resilient engagement surface are positioned for engaging end portions of the gripper elements (6) to apply indirect pressure on the sheet for impaling the sheet on the projection means.

16. Machine according to claim 1, wherein the printing line of the blanket cylinder structure (1) is shifted forwardly—with respect to the direction of rotation of the cylinder—for engagement of the rubber blanket on the blanket cylinder with end portions of the gripper elements (6) and applying said force indirectly on the sheet for impaling the sheet on the projection means via said end portions of the grippers.

17. Machine according to claim 16, wherein the gripper elements have gripping end portions; and said projection means are located under said gripping end portions.

18. Machine according to claim 1, wherein the printing cylinder is formed as a rubber blanket cylinder including said gripper elements.

19. Machine according to claim 1, wherein the printing cylinder is formed as a plate cylinder including said gripper elements.

20. Machine according to claim 1, wherein said gripper elements include resilient end portions;

the projection means are located beneath said resilient end portions of the gripper elements;

and the blanket cylinder structure (1) is positioned to engage said resilient end portions for indirectly applying pressure on said sheet for impaling the sheet on the projection means beneath the resilient end portions of the gripper elements.

* * * * *